US006252519B1

(12) United States Patent
McKenna

(10) Patent No.: US 6,252,519 B1
(45) **Date of Patent: *Jun. 26, 2001**

(54) EMERGENCY VEHICLE SIGNALING SYSTEM

(76) Inventor: Lou McKenna, 2800 Hamline Ave. North, Roseville, MN (US) 55113

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/369,527

(22) Filed: Aug. 6, 1999

Related U.S. Application Data

(60) Provisional application No. 60/096,736, filed on Aug. 17, 1998.

(51) Int. Cl.[7] ..... G08G 1/00

(52) U.S. Cl. ..... 340/902; 340/464; 340/539; 340/904

(58) Field of Search ..... 340/902, 903, 340/904, 463, 464, 470, 471, 539

(56) References Cited

U.S. PATENT DOCUMENTS

| | | | | |
|---|---|---|---|---|
| 2,457,502 | | 12/1948 | Shepherd . | |
| 3,673,560 | * | 6/1972 | Barsh et al. | 340/33 |
| 3,854,119 | | 12/1974 | Friedman et al. . | |
| 3,876,940 | | 4/1975 | Wickord et al. . | |
| 3,997,868 | * | 12/1976 | Ribnick et al. | 340/33 |
| 4,694,296 | * | 9/1987 | Sasaki et al. | 340/904 |
| 4,764,978 | * | 8/1988 | Argo et al. | 455/1 |
| 5,091,726 | * | 2/1992 | Shyu | 340/904 |
| 5,235,329 | * | 8/1993 | Jackson | 340/902 |
| 5,289,181 | * | 2/1994 | Watanabe et al. | 340/902 |
| 5,424,726 | * | 6/1995 | Beymer | 340/902 |
| 5,495,243 | * | 2/1996 | McKenna | 340/902 |
| 5,497,148 | | 3/1996 | Oliva . | |
| 5,841,367 | * | 11/1998 | Giovanni | 340/903 |
| 5,926,112 | * | 7/1999 | Hartzell | 340/902 |

* cited by examiner

*Primary Examiner*—Daniel J. Wu
*Assistant Examiner*—Phung T Nguyen
(74) *Attorney, Agent, or Firm*—Haugen Law Firm PLLP

(57) ABSTRACT

Emergency vehicle signaling system wherein an emergency vehicle transmits an RF signal having a narrow cone calculated to be received in a second vehicle. The receiver for the second vehicle is equipped with an indicator in the form of a white light which blinks in order to alert the driver of the emergency vehicle that the RF signal which it is transmitting has been received by the second vehicle. Accordingly, occupants of the second or non-emergency vehicle are made aware of the presence of the emergency vehicle while the visual indicator confirms reception of the RF signal.

2 Claims, 1 Drawing Sheet

EMERGENCY VEHICLE SIGNALING SYSTEM

CROSS-REFERENCE TO RELATED APPLICATION

Figure 1:
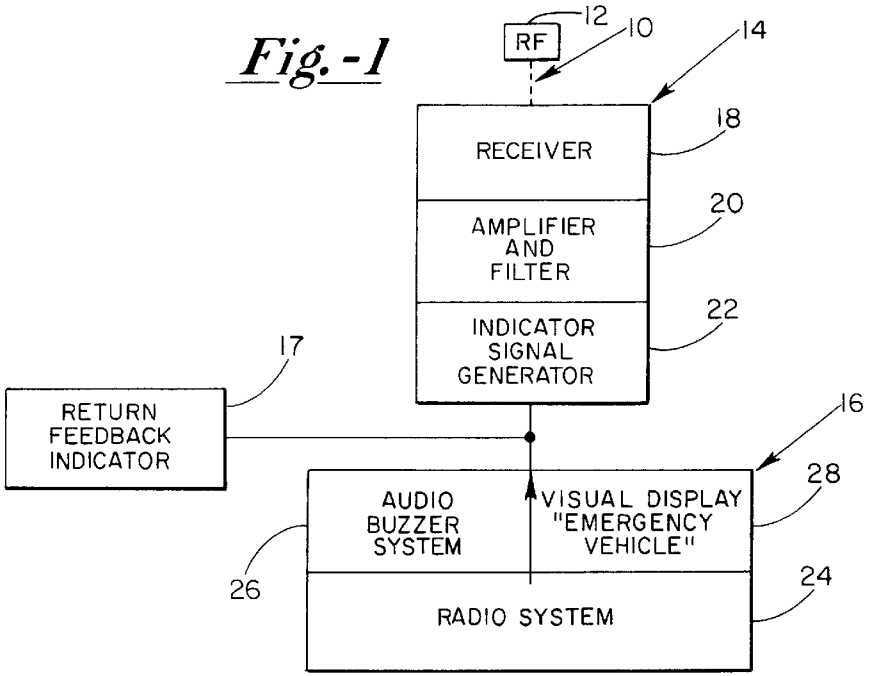

The present application relates to Provisional Patent Application Serial No. 60/096,736, filed Aug. 17, 1998 of Lou McKenna, entitled "EMERGENCY VEHICLE SIGNALING SYSTEM".

BACKGROUND OF THE INVENTION

I. Field of the Invention:

This invention relates generally to alarm systems for indicating to the driver of an emergency vehicle that a second vehicle in its proximity has been alerted to the presence of the emergency vehicle. More particularly, this invention relates to a vehicular alarm and indicator system which is activated by an RF signal generated in the emergency vehicle, so that the occupants of the non-emergency vehicle are made aware of the presence of the emergency vehicle and furthermore, a visual indicator confirms that the RF signal has been received in the non-emergency vehicle. This application is an improvement over my prior U.S. Pat. No. 5,495,243 issued Feb. 27, 1996.

II. Discussion of the Prior Art:

Many modern vehicle passenger compartments are designed and built to be quiet when their windows are closed. Outside noises coming from car horns and radios are prevented from entering the passenger compartment and distracting the driver. Unfortunately, emergency vehicle sirens and train whistles are also prevented from entering the passenger compartment. Car radios or sound systems played at moderate levels inside the vehicle make it even more difficult to hear outside alarms. Thus, an emergency vehicle siren or a train whistle may be undetected by the occupants of a vehicle. In addition, various distractions may be occurring in the vehicle so that the emergency vehicle remains undetected, and this creates a hazardous situation on the highways.

Emergency vehicles need an unobstructed path to respond to an emergency within an acceptable time frame. The occupants of the emergency vehicle need to be able to change traffic signals and alert the drivers of other vehicles to the presence of the emergency vehicle. In the past, radio frequency energy has been used to alert the occupants of one vehicle to the presence of another vehicle. Radio frequency signals were transmitted from one vehicle and detected by an unsuspecting second vehicle. Upon detection, a warning signal was generated in the second vehicle. The warning signal was transmitted over the radio or through independent audio and visual components. This method is shown in U.S. Pat. No. 3,854,119 issued to Friedman et al., and U.S. Pat. No. 3,876,940 issued to Wickford et al. In accordance with the present invention, however, an additional feature is added in that the second vehicle is provided with a signaling light normally rear facing which is activated when the radio frequency signal is detected, thereby permitting the occupants of the emergency vehicle to be aware that its signal has been received.

The Friedman et al. patent describes receiving and identifying amplitude modulated signals to operate switching means for activating devices such as audio speakers, light emitting diodes, panel displays or neon lights in relation to the amplitude of the received signals. The Wickford et al. patent discloses a warning device utilizing radio transmission on an assigned frequency having a transmitter in the emergency vehicle and a receiver in the regular vehicle. One feature of the Wickford et al. patent is the conversion of the received signal to the intermediate frequency of a radio receiver, muting the broadcast reception on the radio or turning the radio on (if it is off), and applying a warning signal through the radio system. In each of these patents, the activating radio frequency energy is transmitted in all directions. Radio frequency energy, however, is not easily blocked by buildings or other objects.

In a rural area, where few emergencies occur and few trains travel, an occasional interruption by a train or emergency vehicle alarm signal may be acceptable. However, in a city or suburban environment, emergencies occur more frequently. Also, the operators and occupants of the emergency vehicle find it helpful to be aware of the fact that the occupants of a second vehicle have been alerted to the presence of the emergency vehicle.

To be useful in cities and suburbs, the energy transmitted by the emergency vehicle's alarm system must be limited to the immediate vicinity. The system should regulate traffic flow by changing traffic signals and alerting the drivers of vehicles to the presence of an emergency vehicle. The present invention satisfies these requirements by utilizing an RF signal of acceptable power wherein the signal is generated and transmitted from an emergency vehicle such as an ambulance, police vehicle, or the like. The RF signal is detectable for a limited distance utilizing a suitable antenna, thereby permitting its use in areas where its detection would otherwise be deemed undesirable.

Light has been used in the past to change traffic signals to accommodate emergency vehicles. One such system is described in U.S. Pat. No. 2,457,502 issued to Shepherd. The Shepherd patent discloses the use of modulated polarized light signals to selectively effect remote control operations by means of light or similar energy. One application described in the Shepherd patent is the use of polarized and modulated light to cause a control mechanism to function and result in the production of a predetermined traffic signal at an intersection. A system much simpler than this for changing traffic signals is currently offered by 3M and includes a high or low priority emitter assembly strobe light and the Opticom® detector and the traffic signal is changed to allow the emergency vehicle to pass through.

From the above analysis, it can be seen that the prior art references of which we are aware, individually and as a whole, do not disclose an emergency vehicle alarm system utilizing an RF signal to alert the occupants of a possibly unsuspecting vehicle to the presence of the emergency vehicle, and further advising the operator and occupants of the emergency vehicle that the other vehicle has been properly alerted.

SUMMARY OF THE INVENTION

The present invention is directed to an RF activated alarm system for indicating the presence of an emergency vehicle, and also providing a visual indication of the reception of the RF signal. The first vehicle is typically an emergency vehicle such as an ambulance, police car or fire truck equipped with an RF signal generator. The system of the present invention comprises a receiver to be located in a conventional non-emergency vehicle, and the receiver then creates an audible as well as visual response to alert the driver and occupants of the presence or close proximity of an emergency vehicle. Additionally, the receiver activates a light, normally a white light located in the rear window of the non-emergency vehicle to assure the operator of the emergency vehicle that their signal has been received. One typical application positions the white light immediately above the center rear elevated stop light of the conventional non-emergency vehicle.

Therefore, the occupants of the non-emergency vehicle are alerted to the presence of an emergency vehicle, train, or the like, and the operators of the emergency vehicle are advised of the fact that their signal has been received. The radio in a conventional non-emergency vehicle may be activated and an audio signal or alert is given. Additionally, a second indicator may be present in the vehicle such as a visual indicator which flashes or displays the words "EMERGENCY VEHICLE" to the occupants. Various combinations or alternatives of these may be provided.

In addition to the indicators above, a visual indicator is provided for notifying the driver of the emergency vehicle that the warning has been received by the non-emergency vehicle. The return feedback indicator is either a constant or blinking white light source preferably situated in the rear window well stop light and/or in the front or rear area of the non-emergency vehicle next to the regular driving lights. Once activated, the return feedback indicator remains lit for a specified period of time so as to allow law enforcement officials in the area of the emergency vehicle to identify cars that have received a light signal and refused to pull over so that the drivers can be appropriately cited.

Other objectives and features of the present invention will become apparent to those skilled in the art through the description of the preferred embodiment and drawings herein.

IN THE DRAWINGS

Figure 2:
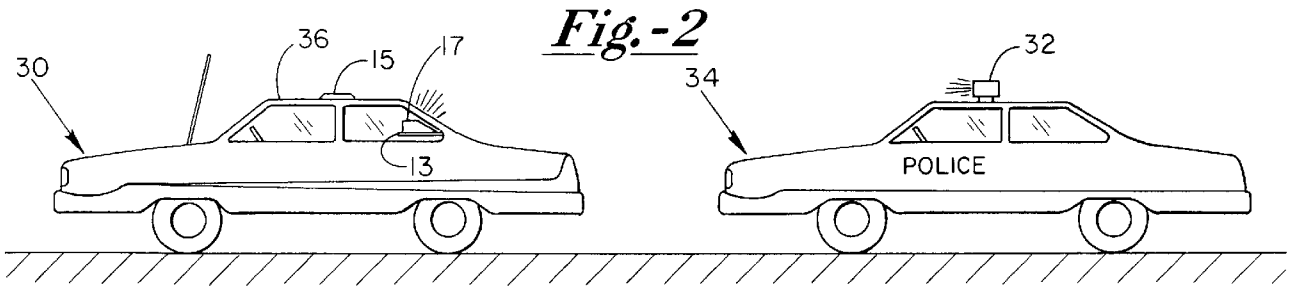

FIG. 1 is a block diagram schematic of the present invention including the photosensitive cell, receiver circuit and indicators; and FIG. 2 is a diagrammatic view of two vehicles wherein one automobile has the photosensitive cell of the present invention situated in either the rear window well or on the roof and a return feedback indicator situated in the rear window well stop light, and the emergency vehicle has a light source.

DESCRIPTION OF THE PREFERRED EMBODIMENT

Indicated in FIG. 1 is a block diagram schematic of an emergency vehicle alarm system 10 for alerting the occupants of a second vehicle to the presence of a first vehicle. The alarm system 10 comprises a RF generator or transmitter 12 positioned in an emergency vehicle and arranged to deliver a signal to a receiver circuit 14 which is mounted in conventional non-emergency vehicles. The receiver 14 is in turn connected to audio and visual indicator 16 and a return feedback white light indicator 17. The RF signal generated in transmitter 12 is received in the non-emergency vehicle through receiver circuit 14 using well-known circuit configurations. Receiver circuit 14 senses or detects the signal in the detector portion 18 of the receiver. The signal detected is relayed to the amplifier and filter 20 of the receiver circuit 14. The amplifier and filter 20 of the receiver circuit 14 amplifies, filters and identifies the detected signal as originating from an activated suitably identified RF transmitter. Once the signal is identified as originating from the appropriate transmitter, a signal is relayed to the signal generator 22 of the receiver circuit 14. The signal generator 22 of the receiver circuit 14 generates the indicator signals for activating the internal indicators 16 and return feedback indicator 17 of the alarm system 10.

As shown in FIG. 1, three different internal indicators are used to alert the occupants of the second vehicle to the presence of the first vehicle. One indicator is the second vehicle's radio system 24, a second indicator is a separate audio speaker or buzzer system 26, and a third indicator is a visual display 28. Additional circuitry is provided to turn on or mute the radio system 24 and transmit a signal over the radio system 24. The audio speaker or buzzer system 26 is activated independently of the radio system 24, or the radio system 24 can be temporarily muted or turned off and an indicator signal transmitted over the audio speaker or buzzer system 26. The visual display 28 flashes a warning signal such as the words "EMERGENCY VEHICLE" or a red light to indicate that a vehicle having an activated RF transmitter is in the area. The indicators 16 discussed above can be used separately or in any combination, including the use of all three indicators 16.

The return feedback indicator 17 is preferably a constant or blinking white light source. The feedback indicator 17 may be situated in a variety of places on the second vehicle 30 including in the rear window well stop light, the front head-light area or the rear tail-light area. The second vehicle 30, as shown in FIG. 2, has the return feedback indicator 17 situated in the rear window well stop light. The feedback 17 notifies the occupants of the first vehicle 34 that the RF signal transmitted was detected and processed by the second vehicle 30. The return feedback indicator 17 remains activated for a predetermined period of time, such as five minutes, to allow law enforcement officials to identify vehicles that have received an emergency signal but refused to pull over the side of the road. The drivers of these vehicles can then be ticketed for refusal to pull over.

As diagrammed in FIG. 2, the alarm system 10 is situated on a second vehicle 30 and a RF source 32 is situated on first vehicle 34. The first vehicle 34 may be any vehicle including a train, ambulance, police car or fire truck. The receiver 14 shown in FIG. 2 is preferably situated in either the rear window well stop light of the second vehicle 30 or on the roof 36 of the second vehicle 30. When the receiver 14 is mounted in the rear window well of the second vehicle 30, the alarm system 10 is used primarily to identify a first vehicle 34 approaching from the rear of the second vehicle 30.

In operation, the first vehicle 34 activates the RF transmitter 32. The signal emitted is sensed or detected by the receiver 14 on the second vehicle 30 and processed by the receiver. A return signal is transmitted from the return feedback indicator 17 to notify the driver of the first vehicle 34 that the signal from the RF transmitter was received by the second vehicle 30. Indicators 16 inside the second vehicle 30 alert the occupant to the presence of the first vehicle 34. The return feedback indicator remains activated to alert law enforcement officials to vehicles that receive a signal but do not pull over. The drivers of these vehicles may then be ticketed. In this manner, the hazards of a speeding emergency vehicle or train are minimized.

An additional advantage or feature of the invention is that the RF transmitter may be designed to have a relatively narrow cone angle of transmission, thereby limiting the exposure of the transmitted signal to other vehicles which are in the immediate path of the emergency vehicle. In this fashion, therefore, the emergency vehicle may limit the extent to which it alerts other vehicles of its presence. Such a feature is advantageous, particularly in situations where a police vehicle may be responding to a reported crime.

What is claimed is:

1. In combination with an emergency vehicle and a second land-traveling vehicle, a radio-frequency signal-responsive driver alert system arranged for activation by the driver of the emergency vehicle for alerting the driver of the second vehicle to the proximity of the emergency vehicle and for confirming to the driver of the emergency vehicle that the transmitted radio-frequency signal has been received by the second vehicle;

(a) said driver alert system comprising:

(1) a radio-frequency signal generator for emitting a signal within a predetermined forwardly directed focused pattern for transmission by the emergency vehicle of a radio-frequency signal indicative of the proximity of the emergency vehicle to the second vehicle, said radio-frequency signal generator emitting the said focused signal from the emergency vehicle forwardly and along the direction of travel to the second land-traveling vehicle within the focal zone of the focused signal;

(2) signal receiving means carried by the second land-traveling vehicle for receiving and identifying the radio-frequency signal as coming from the emergency vehicle and for generating a selected indicator signal in response thereto; and (3) indicator means carried by the second land-traveling vehicle for acknowledging to the emergency vehicle the receipt of the focused radio-frequency signal coming from said emergency vehicle, said indicator means transmitting a visible return white light signal along a rearwardly directed path to the driver-occupant of the emergency vehicle to notify the driver-occupant of the emergency vehicle that the second land-traveling vehicle has received said focused radio-frequency signal, said indicator means being connected to said radio-frequency signal receiving means and activated thereby; and (c) said radio-frequency transmitter has a relatively narrow cone angle of transmission, thereby having means for generating a signal having a relatively narrow cone angle of transmission, thereby limiting the exposure of the transmitted signal to other vehicles which are in the immediate path of the emergency vehicle.

2. In combination with an emergency vehicle and a second land-traveling vehicle of claim 1 being particularly characterized in that said indicator means remains activated for a predetermined finite time following each activation event.

* * * * *